United States Patent [19]

Thomas et al.

[11] Patent Number: 4,820,074

[45] Date of Patent: Apr. 11, 1989

[54] UNIVERSAL CENTER HOOK

[75] Inventors: Kent Thomas, Mayville; Daniel R. Bullis, Jr., Madison; Thomas J. Bottelson, Baraboo, all of Wis.

[73] Assignee: Tab Products Company, Palo Alto, Calif.

[21] Appl. No.: 153,345

[22] Filed: Feb. 8, 1988

[51] Int. Cl.[4] ..... B42F 13/00; B42F 13/22; B42F 13/36; B42F 13/26

[52] U.S. Cl. ..... 402/75; 402/29; 402/73; 312/330 SN

[58] Field of Search ..... 402/29, 52, 54, 55, 402/60, 61, 62, 63, 64, 68, 73, 74, 75; 281/25 R, 45, 48, 49, 50; 24/67 PR; 411/500, 508, 510; 312/330

[56] References Cited

U.S. PATENT DOCUMENTS

| | | | |
|---|---|---|---|
| 687,941 | 12/1901 | Radford et al. | 402/61 |
| 964,668 | 7/1910 | Loewenbach | 402/74 |
| 1,052,531 | 2/1913 | Trumper | 402/74 |
| 1,052,532 | 2/1913 | Trumper | 402/74 |
| 1,167,639 | 1/1916 | Eifel | 402/61 |
| 1,640,646 | 8/1927 | Goger et al. | 402/62 |
| 2,000,357 | 5/1935 | Smith | 281/25 R |
| 3,244,179 | 4/1966 | Forteous et al. | 312/330 |
| 4,445,799 | 5/1984 | Wright et al. | 402/73 |
| 4,730,972 | 3/1988 | Sun et al. | 402/62 |

FOREIGN PATENT DOCUMENTS

| | | | |
|---|---|---|---|
| 2944009 | 5/1980 | Fed. Rep. of Germany | 402/73 |
| 2159099 | 11/1985 | United Kingdom | 402/75 |

*Primary Examiner*—Frank T. Yost
*Assistant Examiner*—Paul M. Heyrana, Sr.
*Attorney, Agent, or Firm*—Donald Cayen

[57] ABSTRACT

A universal center hook is designed to be used with several office accessories for handling data media. The universal center hook comprises an elongated frame to which are pivotally joined a pair of side members. A selected accessory is captured between the frame and a side member when the side member is pivoted to a closed operative configuration wherein it lies parallel to and close to the frame. Hollow cylinders projecting from the frame sides align with and locate the accessories. The hollow cylinders cooperate with means in the side members to releasably lock the side member to the frame.

15 Claims, 4 Drawing Sheets

UNIVERSAL CENTER HOOK

BACKGROUND OF THE INVENTION

1. Field of the Invention.

This invention pertains to media handling systems, and more particularly to apparatus for organizing printed documents.

2. Description of the Prior Art.

A variety of document management products has been developed to help meet the demand for ever greater productivity in modern offices. For example, a cartridge type document holder, disclosed in copending U.S. patent application Ser. No. 153,344 filed Feb. 8, 1988 binds a sheaf of documents together for convenient handling and storage. copending U.S. patent application Ser. No. 153,344 filed Feb. 8, 1988 describes an adjustable handle that is intended primarily for hanging and otherwise handling a separately bound set of documents.

Other commercially available products include a carrier that consists of a pair of hooked plastic frames bonded to the opposed ends of a length of flexible material. The two plastic strips are placed side by side to create an open ended sling suitable for hanging.

The aforementioned document management devices are satisfactory for their intended purposes. However, the prior products are primarily intended for a single purpose. That is, they are designed for use within a limited range of the numerous document handling and storage applications found in the modern office.

Another conventional document holder is a binder that comprises two wire cables inserted through aligned holes in two hooked frames. Metal tracks with sliding locks on the outside of the frames hold the cables in place. The wire cables pass through mounting holes in the documents for supporting the documents within the binders. The metal tracks and sliding locks make the aforedescribed binder expensive and cumbersome to operate.

Thus, a need exists for inexpensive document management products that are more versatile than those presently available.

SUMMARY OF THE INVENTION

In accordance with the present invention, a universal center hook is provided that is adapted to be used in a variety of ways for organizing and handling data media. This is accomplished by apparatus that includes an elongated frame in cooperation with a pair of pivotable side members for releaseably holding several different office accessories.

The universal center hook frame is fabricated as a flat plate with a pair of arms that extend oppositely from the plate sides so as to form a cruciform cross section. The frame is further formed with a hooked opening i one edge, thereby enabling the frame and side members to be hung from a horizontal bar. The side members are formed as flat strips, and they are pivotably joined to a corner of a respective frame arm. Connection of the side members to the frame arms is by respective living hinges. The side members are pivotable between an open inoperative configuration wherein they are approximately perpendicular to the plane of the frame plate and a closed operative configuration wherein they lie adjacent the frame plate.

To releaseably retain the side members against the frame in the closed operative configuration, the frame and side members are formed with cooperating locking components. The frame locking components also serve to locate the various accessories used with the universal center hook. In the preferred embodiment, the locking components comprise a series of slotted hollow cylinders extending oppositely from the sides of the frame plate, together with a series of cooperating openings in the side members. The slotted cylinders and side member openings are dimensioned such that the side members snap over and are retained by the hollow cylinders when the universal center hook is in the closed operative configuration, but the side members are easily intentionally pivoted out of engagement with the frame when desired.

The interlocking frame hollow cylinders and the side member openings are linearly spaced so as to interfit with a variety of media related accessories. One accessory is a flexible rectangular sheet of vinyl or similar material that is supported along two opposed ends by a pair of universal center hooks so as to create an open ended sling. A second accessory is an outguide, which consists of a sheet of vinyl-like material carrying information pertaining to the removal of media from a stored location. The universal center hook of the present invention is also designed for use in pairs to support the flexible cables frequently used to bind computer printouts and other thick stacks of paper. The cables pass through the frame hollow cylinders and the openings of one side member of each universal center hook of the pair. The cable ends are easily but securely captured between the frame plate and the other side member of each universal center hook of the pair.

Other advantages, benefits, and features of the invention will become apparent to those skilled in the art upon reading the detailed description of the invention.

DETAILED DESCRIPTION OF THE INVENTION

Figure 1:
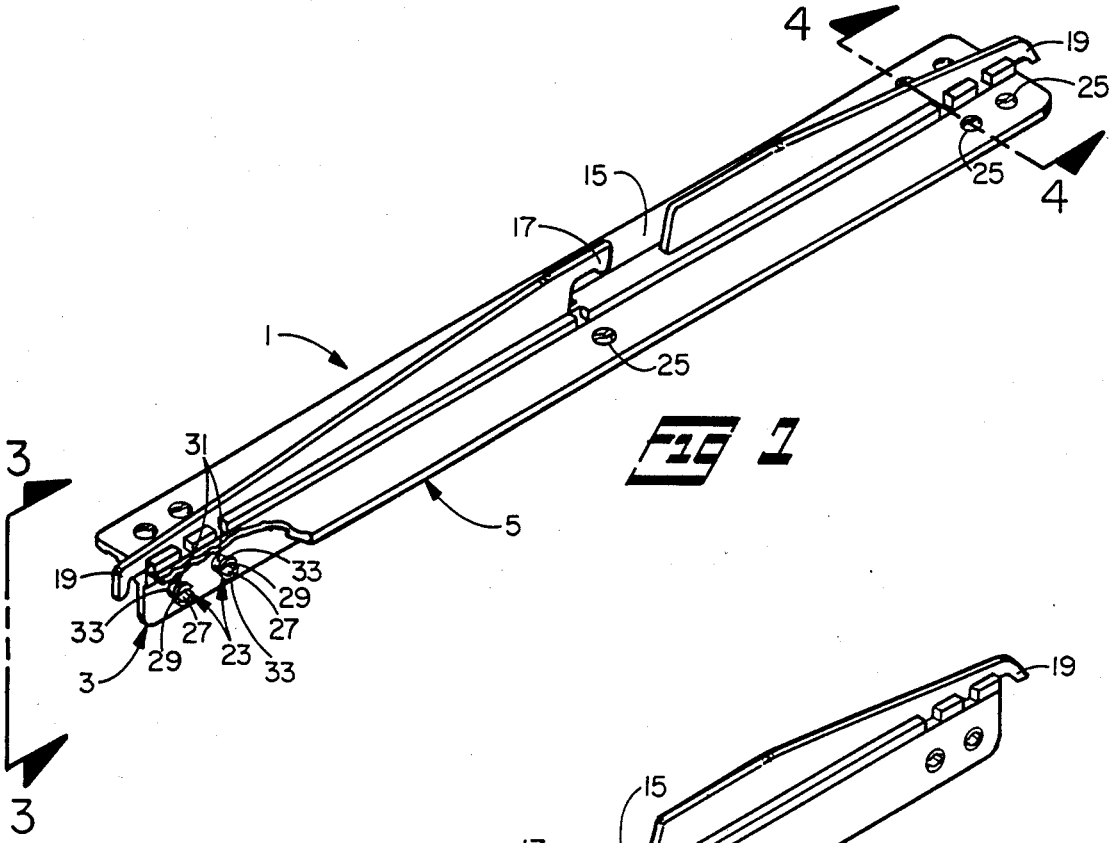
FIG. 1 is a perspective view of the universal center hook of the present invention shown in the open inoperative configuration.

Although the disclosure hereto is detailed and exact to enable those skilled in the art to practice the invention, the physical embodiments herein disclosed merely exemplify the invention which may be embodied in other specific structure. The scope of the invention is defined in the claims appended hereto.

Referring to FIGS. 1–4, a universal center hook 1 is illustrated that includes the present invention. The universal center hook is primarily intended to be used with other simple and inexpensive office products for efficiently managing selected data media.

The universal center hook 1 comprises an elongated frame 3, to which are pivotly attached a pair of flat strip-like side members 5 and 7. The frame 3 is formed as a generally flat narrow plate 9. From the opposed sides of the plate 9 extend a pair of short arms 11 that preferable extend the full length of the plate. The pivotal connections between the plate and the side members 5 and 7 are by respective living hinges 13 between the lower corners of the arms and the respective side members. To hang the universal center hook from a rack, not shown, the frame plate is formed with an opening 15 that is partially closed by a hook 17. The frame terminates on its opposed longitudinal ends with downwardly facing hooks 19 for suspending the universal center hook on a pair of parallel bars, not illustrated in FIGS. 1–4.

Figure 2:
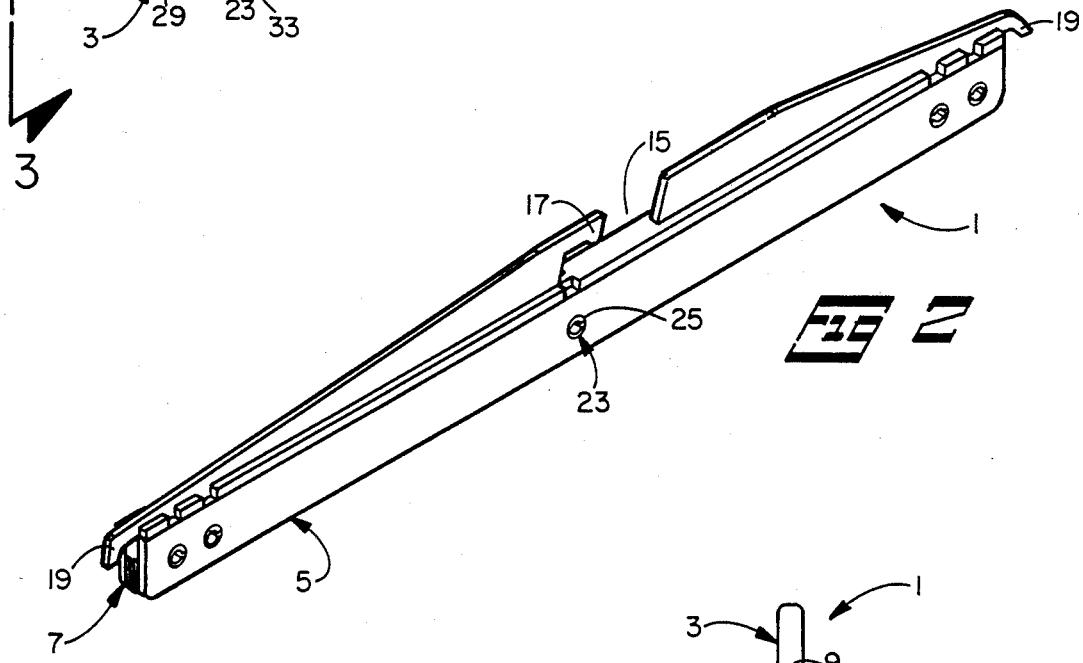
FIG. 2 is a perspective view of the universal center hook in the closed operative configuration.
Figure 3:
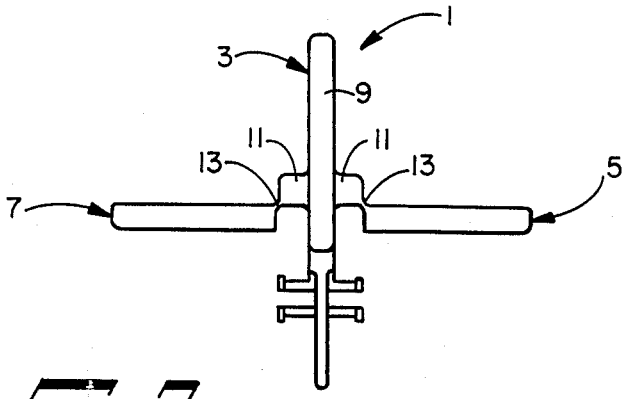
FIG. 3 is a view taken along lines 3—3 of FIG. 1.
Figure 4:
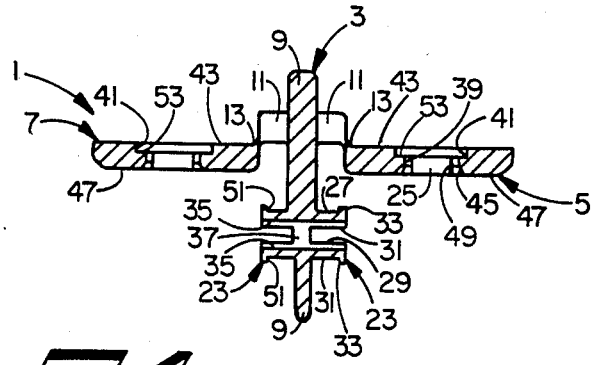
FIG. 4 is an enlarged cross sectional view taken along lines 4—4 of FIG. 1.

FIGS. 1, 3, and 4 show the universal center hook 1 in the open inoperative configuration, wherein the planes of the side members 5 and 7 are approximately perpendicular to the plane of the frame plate 9. FIG. 2 shows the universal center hook in the closed operative configuration wherein the side members are flush against the frame 3.

To retain the universal center hook in the closed operative configuration, the frame 3 and side members, 5, 7 are fabricated with several releaseable locking devices. In the illustrated construction, each locking device comprises a male member 23 formed on the frame plate 9 and a cooperating opening 25 in the side member 5 or 7. Referring primarily to FIGS. 1 and 4, the male member 23 is formed as a hollow cylinder 27 having its longitudinal axis perpendicular to the plane of the frame plate. The hollow cylinder 27 has a slot 29 extending diametrically therethrough so as to create two partial annular rings 31. One end of the hollow cylinder is integrally joined to the frame plate. The hollow cylinder free end is provided with an outwardly projecting partial flange 33. Preferably, the male members are formed in oppositely extending concentric pairs. The inner diameter 35 of the hollow cylinder extends through the plate, thereby creating a hole 37 through the plate.

In the preferred embodiment, the openings 25 extend through the side members 5 and 7. Each opening is composed of a through hole 39 with a flat first counterbore 41 in the side member top surface 43 and a tapered second counterbore 45 in the side member bottom surface 47. A longitudinal slot 49 having a width less than the diameter of the holes 39 is cut into the bottom surfaces 47 symmetrical about the longitudinal axes of the holes 39. The dimensions of the male members 23 and the openings 25 are such that the flanges 33 strike the tapered counterbores 45 when the side members 5 and 7 re pivoted toward the closed operative configuration. Consequently, the split cylinders 27 deflect toward their respective longitudinal axes. The flanges rub against the hole 39 as the side members are further pivoted. When the side members have attained the closed operative configuration, the flanges emerge from the holes 39 and resiliently return to their undeflected positions. The side members are retained in the closed configuration by the undercut surfaces 51 of the flanges acting in conjunction with the steps 53 of the counterbores 41. The side members may be easily intentionally released from the frame 3 by prying between the frame plate 9 and the side member bottom surface.

Figure 5:
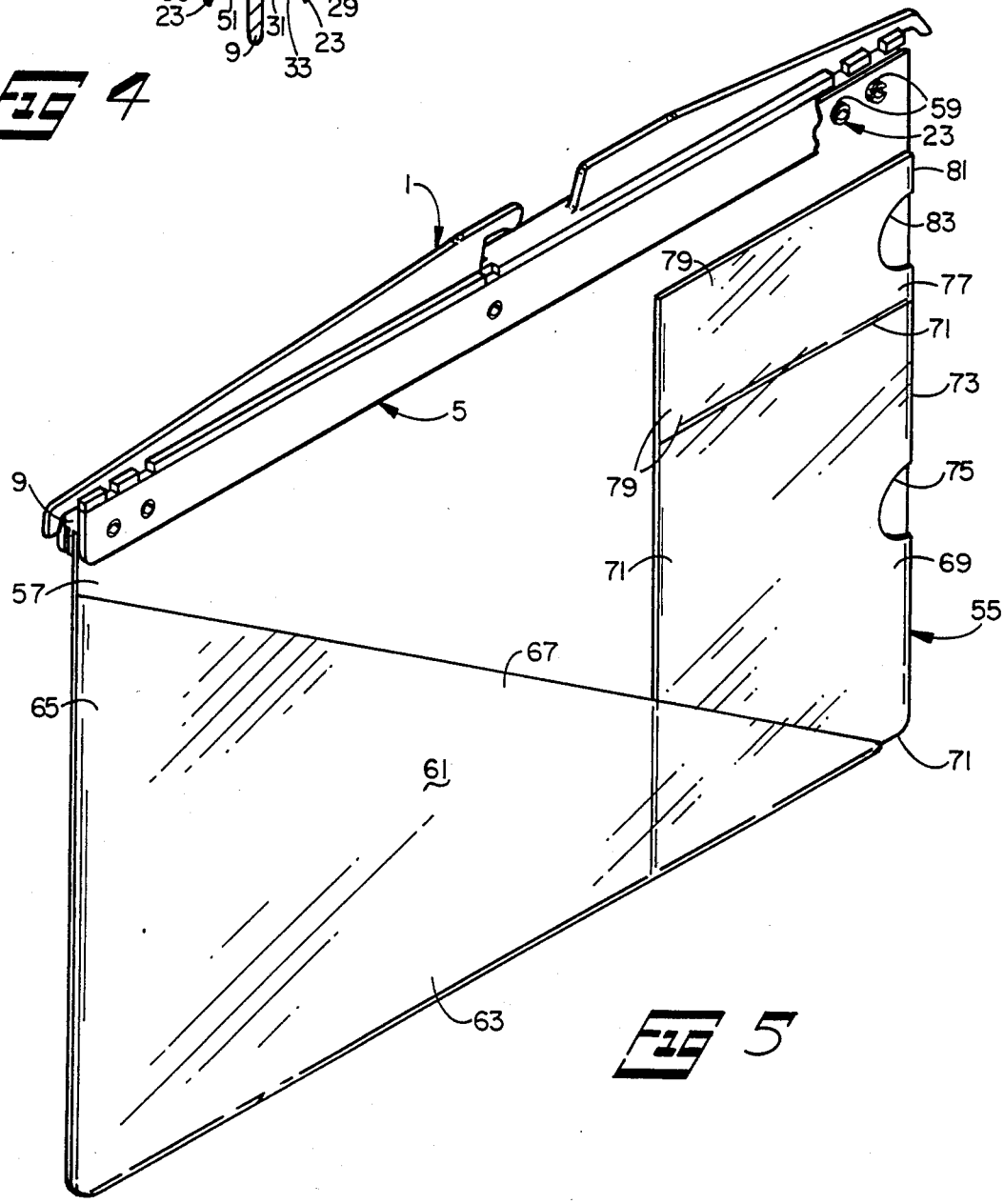
FIG. 5 is a partially broken perspective view of the universal center hook of the present invention in use with an outguide.

An application of the universal center hook 1 of the present invention is illustrated in FIG. 5. In FIG. 5, a universal center hook is shown in the closed operative configuration in cooperation with a media information accessory 55. The accessory 55 is depicted as a product known as an outguide. The outguide is comprised of a flat piece 57 of flexible but tough material, such as a vinyl plastic, that is formed with holes 59 for fitting over the male members 23 of the universal center hook. The vinyl piece 57 is sandwiched between the universal center hook plate 9 and one of the side members 5 or 7.

The outguide is formed with three transparent pockets. The first pocket 69 is formed by bonding three margins 71 of a piece of transparent material to the sheet 57, so that a transparent pocket with an open side 73 is created for holding an information carrying card, not illustrated in FIG. 5. To provide easy removal of the card, a notch 75 may be cut in the transparent pocket open side 73. The second pocket 77 is generally similar to the pocket 69, having margins 79 of a transparent material bonded to the sheet 57 to create a pocket with an open side 81. A notch 83 in the pocket open side 81 permits easy access to a printed card or other similar item inserted into the pocket 77. The third pocket 61 is formed by bonding margins 63 and 65 of a piece of transparent material to the vinyl sheet 57. The margin 67 is unbonded to the sheet 57, thereby forming a large pocket for removably storing selected data sheets.

Figure 6:
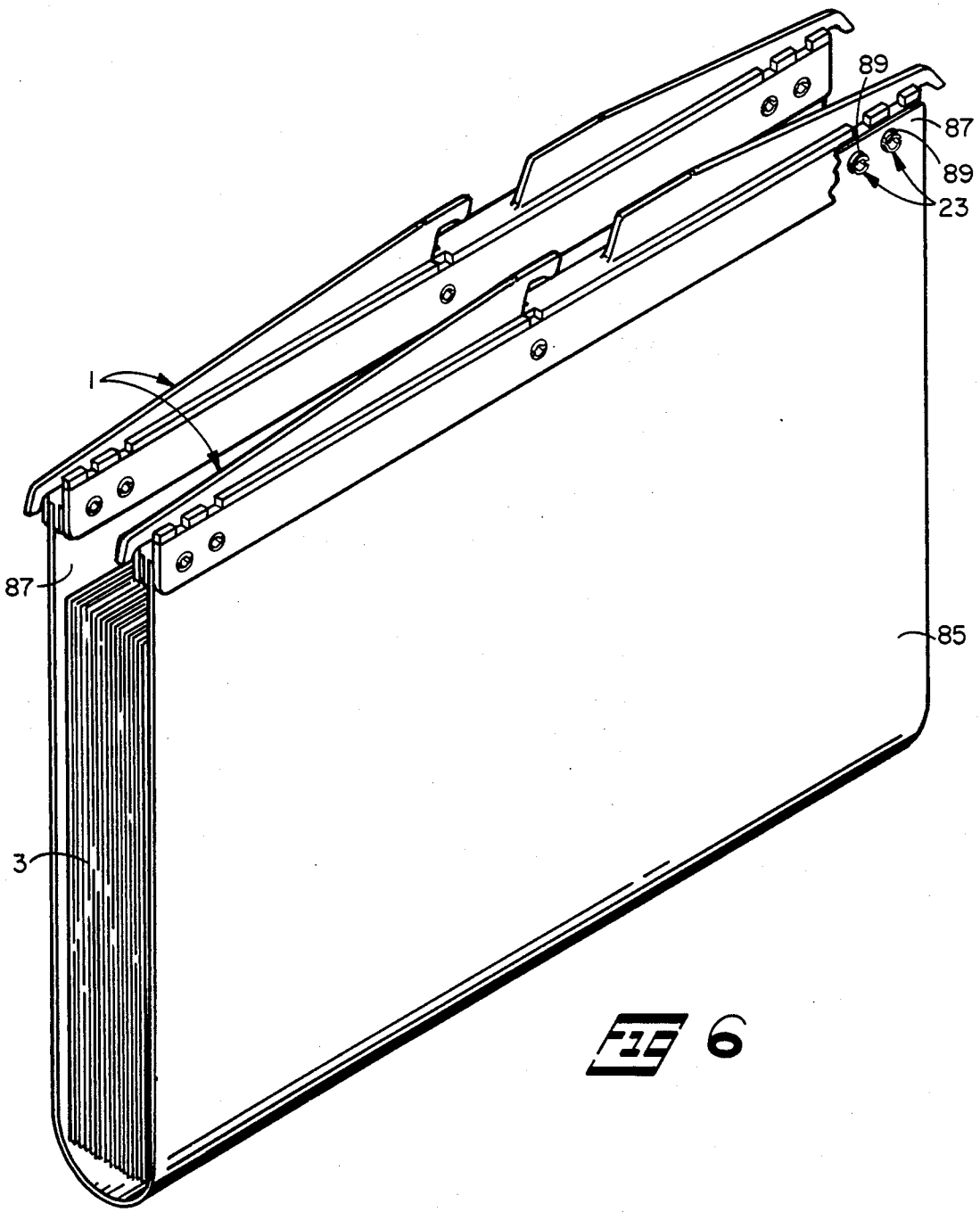
FIG. 6 is a partially broken perspective view of the universal center hook in use with a sling.

Turning to FIG. 6, a second application of the universal center hook 1 of the present invention is depicted. In FIG. 6, a pair of universal center hooks is used in combination with a piece 85 of tough flexible material, such as a vinyl plastic. The opposed ends 87 of the piece 85 are manufactured with holes 89 for locating over the male members 23 of the two universal center hooks. With the universal center hooks in the closed operative configuration, they cooperate with the material piece 85 to create an open end sling for storing selected documents.

Figure 7:
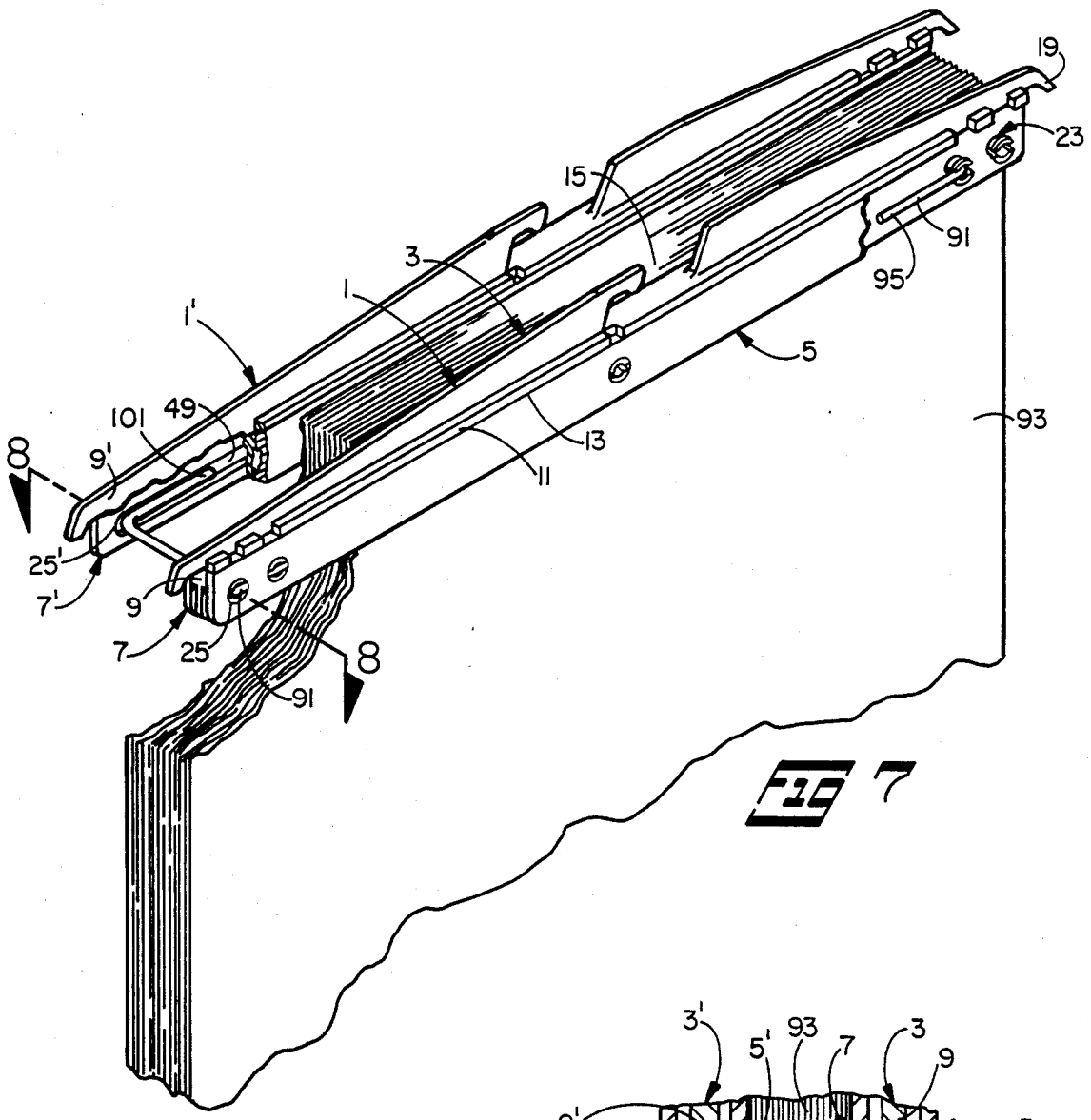
FIG. 7 is a partially broken perspective view of the universal center hook in use with binder cables.
Figure 8:
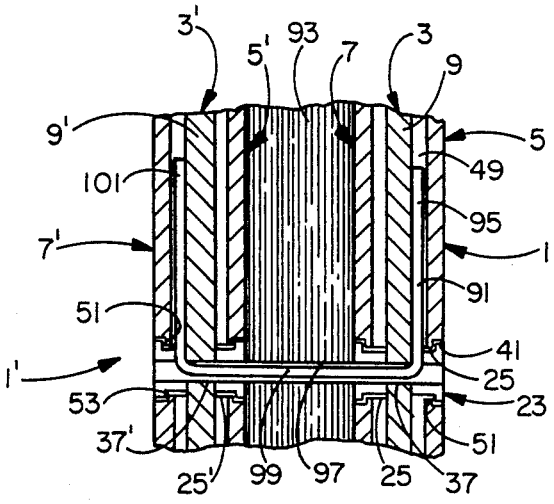
FIG. 8 is an enlarged cross sectional view taken along lines 8—8 of FIG. 7.

Turning next to FIGS. 7 and 8, a third application of the universal center hook of the present invention is disclosed. In FIGS. 7 and 8, a pair of universal center hooks 1 and 1', is used in combination with a pair of conventional wire cables 91 for binding and handling a thick stack of papers 93. The cables 91 are tightly retained in the universal center hooks 1 and 1', without the need for additional locking members. This is accomplished by pivoting the side member 7 of universal center hook 1 and side member 5, of universal center hook 1', to the closed operative configurations against the respective frame plates 9 and 9'. The side member 5 of universal center hook 1 and the side member 7', of the universal center hook 1, are pivoted to the open inoperative configuration. One end 95 of each cable is inserted through the aligned holes 25 and 37 in the closed side member 7 and the frame 3, respectively. The cable end 95 is bent to lie against the frame plate 9, and the side member 5 is then pivoted to the closed operative configuration. The cable is received within the slot 49 in the side member 5. The undercut surface 51 of the male member 23 cooperates with the counterbore step 53 to both retain the side member to the frame and to capture the cable in the universal center hook. The mounting holes 97 of the paper 93 are then placed over the center portion 99 of the cable. The free end 101 of the cable is inserted through holes 25' and 37' in the second universal center hook 1'. The cable second end 101 is bent against the frame 3' of the universal center hook 1', and the side member 7′ is pivoted to the closed configuration. In that manner, the cables are securely retained in the two universal center hooks for supporting the papers. It will be understood that for the three applications of FIGS. 5–8, the universal center hooks and corresponding data media accessories retained thereby may be stored by hanging from a rack by means of the center hook 17, or on a pair of parallel bars by the end hooks 19.

Thus, it is apparent that there has been provided, in accordance with the invention, a universal center hook that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A universal center hook comprising:
   a. an elongated frame having a generally planar cross section with generally flat opposed sides;
   b. a pair of elongated side members having respective generally rectangular across sections with opposed surfaces, the side members being attached to the respective opposed sides of the frame and pivotable between an open inoperative configuration wherein the plane of the frame is approximately perpendicular to the planes of the side members and a closed operative configuration wherein the side members lie alongside and generally in facing contact with the respective frame opposed sides; and
   c. lock means for releaseably locking the side members to the frame in the closed operative configuration.

2. The universal center hook of claim 1 wherein the frame is formed with a pair of arms extending oppositely from the sides,
   so that the frame has a generally cruciform cross sectional shape.

3. The universal center hook of claim 2 wherein the side members are attached to the respective frame arms.

4. The universal center hook of claim 1 wherein the lock means comprises:
   a. at least one male member extending from the frame perpendicular to the plane thereof, the male member comprising at least one hollow cylinder joined to and extending oppositely from each side of the frame and having an outer diameter and a substantially smooth inner diameter, the free end of each hollow cylinder being formed with a flange that extends outwardly from the cylinder outer diameter, the flange having a flat undercut surface, each hollow cylinder having a diametral slot therethrough; and
   b. step means recessed between the opposed surfaces of the side members for cooperating with the frame cylinder flanges to releaseably lock the side members to the frame.

5. The universal center hook of claim 4 wherein the frame and the side members define respective openings therethrough concentric with each hollow cylinder.

6. The universal center hook of claim 4 wherein the side member step means comprises a locking surface formed in the side member between the opposed surfaces thereof, the locking surface being engagable with the associated hollow cylinder flange to cooperate therewith to lock the side member to the frame.

7. The universal center hook of claim 4 wherein:
   a. the side member opposed surfaces comprises a top surface and a bottom surface, the side member bottom surface lying in generally facing contact against the frame when the side member is in the closed operative configuration:
   b. each side member defines a hole therethrough for receiving an associated frame cylinder when the side member is in the closed operative configuration;
   c. each side member defines a counterbore extending from the top surface thereof concentric with the side member hole; and
   d. the side member step means comprises a locking surface bounded by the hole and the counterbore and located to engage the cylinder outwardly extending flange when the side member is in the closed operative configuration.

8. The universal center hook of claim 7 wherein each side member defines a longitudinal slot in the bottom surface thereof symmetrical about the hole.

9. A universal center hook comprising:
   a. a frame comprising:
      i. an elongated plate having opposed first and second sides; and
      ii. first and second arms extending oppositely from the respective frame sides;
   b. first and second elongated side members having respective top and bottom surfaces and being pivotally joined by respective living hinges to the plate first and second arms for pivoting between a closed operative configuration wherein the side member bottom surfaces lie against the respective plate sides and an open inoperative configuration wherein the side member bottom surfaces are spaced away from the plate side; and
   c. locking means for releaseably locking the side members to the frame in the closed operative configuration.

10. The universal center hook of claim 9 wherein the locking means comprises:
   a. a plurality of hollow cylinders joined to and extending from the frame with the axes thereof generally perpendicular to the frame plate, the hollow cylinder free ends being formed with respective radially outwardly extending flanges, the hollow cylinders having respective diametral slots therethrough; and
   b. step means formed in the side members for engaging the plate cylinder flanges to releaseably lock the side members to the frame.

11. The universal center hook of claim 10 wherein:
   a. each side member is formed with a hole therethrough in alignment with each frame cylinder when the side member is in the closed operative configuration, each side member hole having the axis thereof perpendicular to the side member bottom surface; and
   b. the side member step means comprises a surface formed therein perpendicular to and extending radially outwardly from the hole axis, the step surface being engagable with the associated cylinder flange to releaseably lock the side member in the closed operative configuration.

12. The universal center hook of claim 10 wherein:

a. each side member is fabricated with a hole therethrough in alignment with each frame hollow cylinder when the side member is in the closed operative configuration, the side member hole having the axis thereof perpendicular to the side member bottom surface;

b. each side member is formed with a counterbore in the top surface thereof concentric with the hole, the counterbore defining a surface that is perpendicular to the hole axis to thereby create the step means for engaging the flanges of the associated hollow cylinder; and c. each side member defines a second counterbore in the bottom surface thereof concentric with each hole, the second counterbore defining a surface that is angled to the associated hole axis and that contacts the flanges of the associated hollow cylinder as the side member is pivoted to the closed operative configuration to thereby deflect the hollow cylinder to permit the flanges thereof to pass through the side member hole.

13. Apparatus for indicating the status of selected data media comprising:

a. an outguide comprising:

i. a sheet of material having opposed sides and at least one generally straight edge, the sheet defining a plurality of holes therethrough along the straight edge; and ii. at least one transparent pocket bonded to the sheet for holding selected data media; and b. a universal center hook comprising:

i. a frame having generally flat parallel opposed sides, one frame side being located in facing contact with the sheet straight edge on one side thereof, the fame defining a plurality of hollow cylinders joined to and extending from at least one frame side and passing through the holes along the sheet edge;

ii. a radially outwardly extending flange formed on the free end of each cylinder; and iii. a side member pivotally joined to the frame and overlying and in facing contact with the sheet straight edge on the other side thereof, the side member defining holes therethrough in alignment with the frame cylinders and the sheet holes, the side member defining surfaces that interest and extend perpendicular to the axes of the respective holes therethrough and that releaseably engage the associated frame cylinder flanges to releaseably lock the side member to the frame and capture the sheet therebetween to thereby retain the sheet to the universal center hook.

14. A sling for holding selected data media comprising:

a. a sheet of generally rectangular flexible material having first and second sides and opposed ends, the sheet margins adjacent the respective opposed ends defining a plurality of holes therethrough; and b. a pair of universal center hooks, each universal center hook comprising:

i. a frame having a generally flat side in facing contact with a selected sheet end on the first side thereof, the frame defining a plurality of cylinders joined to and extending from the frame side and passing through the holes in the selected sheet margin;

ii. a side member pivotally joined to the frame and overlying the selected sheet margin on the second side thereof to capture the sheet between the frame and the side member, the side member defining holes therethrough in alignment with the frame cylinders and the sheet holes; and iii. lock means formed on the frame and side member for releaseably locking the side member to the frame, so that the two universal center hooks capture respective ends of the flexible sheet and the two universal center hooks cooperate with the flexible sheet captured therebetween to create a sling for holding data media.

15. Apparatus for holding a sheaf of papers comprising:

a. first and second universal center hooks, each universal center hook comprising:

i. a frame having generally flat sides that define a plurality of holes therethrough;

ii. a plurality of hollow cylinders joined to and extending from the frame sides in alignment with the holes;

iii. a side member having opposed top and bottom surfaces and being pivotally joined to a frame side for pivoting between a closed operative configuration wherein the side member bottom surface lies against the frame side and an open inoperative configuration wherein the side member bottom surface is spaced away from the frame side, the side member defining a hole therethrough in alignment with each frame hollow cylinder when the side member is in the closed operative configuration, the side member bottom surface being fabricated with a longitudinal groove symmetrical about the side member holes; and iv. lock means formed on the frame cylinders and on the side members for releaseably locking the side member to the frame in the closed operative configuration; and b. a plurality of flexible cables having first and second ends, each cable passing through aligned mounting holes in the papers with the first and second ends protruding from the papers, the first and second ends of each cable passing through selected hollow cylinders in the respective universal center hook frames and being bent to lie against the frame sides and to be captured in the respective side member grooves when the side members are in the closed operative configurations and locked to the frame.

* * * * *